US007086389B2

(12) United States Patent
Yamada

(10) Patent No.: US 7,086,389 B2
(45) Date of Patent: Aug. 8, 2006

(54) GENERAL-PURPOSE ENGINE

(75) Inventor: Yoshikazu Yamada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/981,783

(22) Filed: Nov. 5, 2004

(65) Prior Publication Data

US 2005/0126548 A1 Jun. 16, 2005

(30) Foreign Application Priority Data

Dec. 4, 2003 (JP) ..... 2003-405427

(51) Int. Cl.
*F02M 37/04* (2006.01)

(52) U.S. Cl. ..... 123/516; 123/519

(58) Field of Classification Search ..... 123/516, 123/518, 519, 520; 137/587, 589, 590, 574
See application file for complete search history.

(56) References Cited

U.S. PATENT DOCUMENTS 3,372,679 A * 3/1968 Aitken ..... 123/519
3,757,753 A * 9/1973 Hunt ..... 123/519
4,653,762 A * 3/1987 Nakamura et al. ..... 280/835
4,657,156 A * 4/1987 Uranishi et al. ..... 220/694
4,701,198 A * 10/1987 Uranishi et al. ..... 96/148
4,714,171 A * 12/1987 Sasaki et al. ..... 220/746
4,919,103 A * 4/1990 Ishiguro et al. ..... 123/514
5,408,977 A * 4/1995 Cotton ..... 123/520
5,704,337 A * 1/1998 Stratz et al. ..... 123/519
6,182,693 B1 * 2/2001 Stack et al. ..... 137/565.17
6,269,802 B1 * 8/2001 Denis et al. ..... 123/519
6,273,070 B1 * 8/2001 Arnal et al. ..... 123/519
2005/0121004 A1 * 6/2005 Yamada et al. ..... 123/519

* cited by examiner

*Primary Examiner*—Carl S. Miller
(74) *Attorney, Agent, or Firm*—Arent Fox PLLC

(57) ABSTRACT

A general-purpose engine includes a canister for adsorbing fuel vapor that has evaporated within a fuel tank. The fuel vapor, which has desorbed from the canister, is guided to an intake system communicating with an engine main body. A housing recess is formed in a base of the fuel tank, recesses toward the interior of the fuel tank, and houses the canister. Thus, an external impact to the canister can be avoided while also avoiding any increase in the dimensions of the general-purpose engine.

10 Claims, 6 Drawing Sheets

GENERAL-PURPOSE ENGINE

BACKGROUND OF THE INVENTION

1. Field of the Invention

The present invention relates to a general-purpose engine having a canister to adsorb fuel vapor that has evaporated within a fuel tank, wherein fuel vapor desorbed from the canister is guided to an intake system in communication with an engine main body.

2. Description of the Related Art

A general-purpose engine having a canister disposed within a tank cap of a fuel tank is known from, for example, Japanese Patent Application Laid-open No. 7-34985.

A general-purpose engine usually needs to be compact so that a work machine that includes the general-purpose engine does not become large. A conventional general-purpose engine having a canister disposed within the tank cap causes enlargement to a portion around the tank cap and, thereby, an increase to the overall size of the general-purpose engine. Further, the canister is subject to external impact when attaching and removing the tank cap.

SUMMARY OF THE INVENTION

The present invention has been achieved under the above-mentioned circumstances to provide a general-purpose engine having a canister protected from external impact while also avoiding any increase in the dimensions of the general-purpose engine.

According to a first aspect of the present invention, a general-purpose engine includes a canister for adsorbing fuel vapor that has evaporated within a fuel tank, wherein fuel vapor desorbed from the canister is guided to an intake system in communication with an engine main body, a housing recess is formed in a base of the fuel tank and is recessed toward the interior of the fuel tank, and the canister is housed within the housing recess.

With this arrangement, a lower portion of the fuel tank covers the canister located within the housing recess of the fuel tank. Therefore, it is possible to position the canister within the general-purpose engine without increasing the dimensions of the general-purpose engine. Moreover, external impacts upon the canister are greatly reduced.

According to a second aspect of the present invention, the fuel tank is disposed above an engine component forming a part of the engine main body, the casing of the canister has an open-to-atmosphere hole provided therein which opens toward an engine component, and the open-to-atmosphere hole provides communication between the interior and exterior of the canister.

With this arrangement, the engine main body covers the area around the open-to-atmosphere hole of the canister, greatly reducing the amount of dirt and moisture drawn into the canister via the open-to-atmosphere hole, and thereby greatly improving the durability of the canister.

The above-mentioned aspects, other aspects, characteristics, and advantages of the present invention will become apparent from a preferred embodiment described below in detail by reference to the attached drawings.

DESCRIPTION OF THE PREFERRED EMBODIMENT

Figure 1:
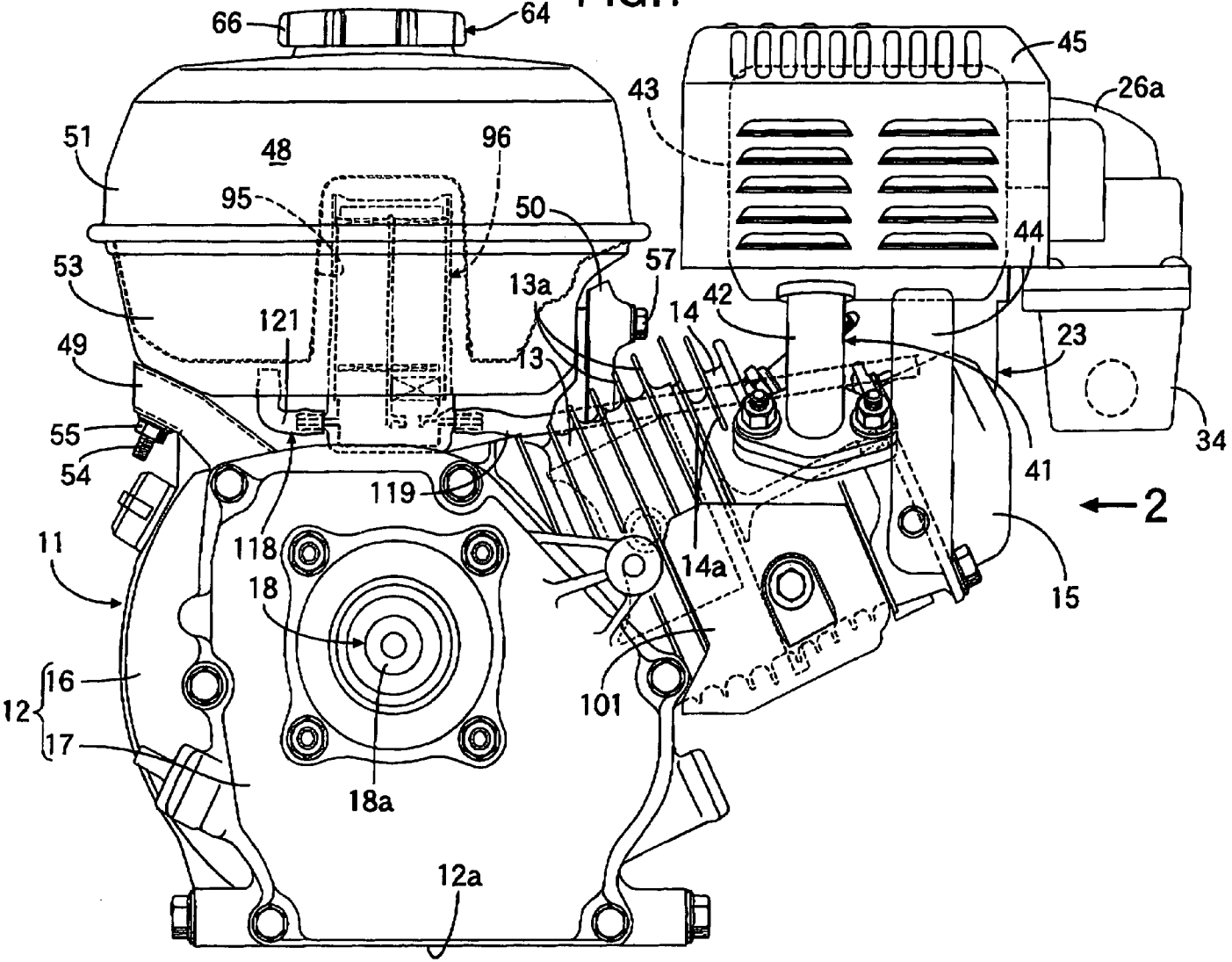
FIG. 1 is a front view of the engine, according to a preferred embodiment of this invention.
Figure 2:
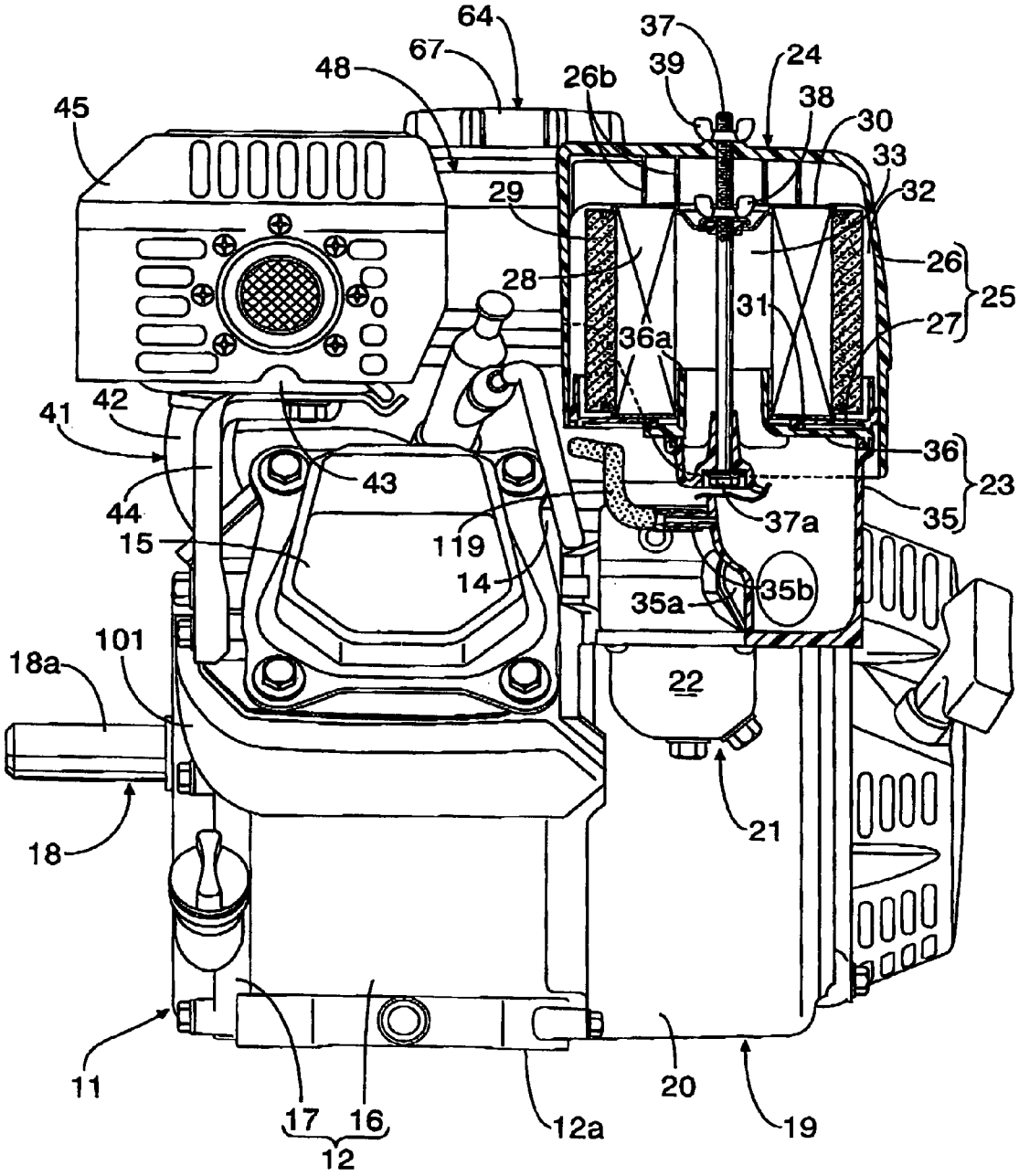
FIG. 2 is a partially cutaway side view of the engine when viewed from the direction of arrow 2 in FIG. 1.

FIG. 1 and FIG. 2 show an air-cooled, single cylinder general-purpose engine used in, for example, a work machine. An engine main body 11 includes a crankcase 12, a cylinder block 13, and a cylinder head 14. The cylinder block 13 is inclined upward and joined to one side of the crankcase 12. The cylinder head 14 is joined to a head of the cylinder block 13. A large number of air-cooling fins 13*a* and 14*a* are provided on outer side faces of the cylinder block 13 and the cylinder head 14. The crankcase 12 is mounted on an engine bed of various types of work machines via a mounting face 12*a* on a lower face of the crankcase 12. A head cover 15 is joined to the cylinder head 14 to cover a valve operating system, which is not illustrated.

The crankcase 12 is formed from a case main body 16 and a side cover 17. The case main body 16 is cast-molded integrally with the cylinder block 13. The side cover 17 is joined to an open end of the case main body 16. A crankshaft 18 has a horizontal axis and is rotatably supported in the crankcase 12. The crankshaft 18 has one end 18*a* projecting from the side cover 17. A recoil starter 19 is connected to the other end of the crankshaft 18. A case 20 of the recoil starter 19 is mounted on the case main body 16 on the side opposite to the side cover 17.

An intake system 21 of the engine includes a carburetor 22, an intake pipe 23, and an air cleaner 24. The carburetor 22 is disposed on one side of the recoil starter 19 and is connected to the cylinder head 14 of the engine main body 11. The downstream end of the intake pipe 23 is connected to the carburetor 22. The upstream end of the intake pipe 23 is connected to the air cleaner 24.

A cleaner case 25 of the air cleaner 24 includes a cleaner case main body 26 and a cover plate 27. The cleaner case main body 26 is formed in a bowl shape opening downward. The cover plate 27 blocks a lower open end of the cleaner case main body 26. Housed within the cleaner case 25 are a cylindrically shaped first cleaner element 28 and a cylindrically shaped second cleaner element 29 coaxially surrounding the first cleaner element 28. Opposite ends, in the axial direction, of each of the first and second cleaner elements 28 and 29 are supported by a pair of disc-shaped retaining plates 30 and 31. The first and second cleaner elements 28 and 29 are housed within the cleaner case 25 so that the retaining plate 31 abuts the cover plate 27.

The interior of the cleaner case 25 is divided into an uncleaned chamber 32 on the outer side and a cleaned chamber 33 on the inner side by the two cleaner elements 28 and 29. Provided integrally with the cleaner case main body 26 of the cleaner case 25 is an inlet pipe portion 26*a*, which communicates with the uncleaned chamber 32. Connected to the inlet pipe portion 26*a* is an inlet pipe 34 for feeding external air into the uncleaned chamber 32.

The external air fed into the uncleaned chamber 32 via the inlet pipe 34 and the inlet pipe portion 26*a* is cleaned while passing through the first 28 and second 29 cleaner elements, and is guided to the cleaned chamber 33. The cleaned air within the cleaned chamber 33 is guided to the carburetor 22 via the intake pipe 23.

The intake pipe 23 extends downward from the air cleaner 24 and includes a pipe 35 and a cover 36. The pipe 35 extends vertically with an open upper end and, in a lower part, includes an integral connecting tube portion 35*a* connected to the carburetor 22. The cover 36 blocks an upper end opening of the pipe 35 and abuts the cover plate 27 of the cleaner case 25 from below. A feed pipe portion 36*a* is provided integrally with the cover 36 and extends through central regions of the cover plate 27 and the retaining plate 31 and projecting into the interior of the cleaned chamber 33 from below.

An increased diameter head portion 37*a* of a bolt 37 engages with the pipe 35 from below. The bolt 37 extends through the pipe 35, the feed pipe portion 36*a* of the cover 36, the retaining plate 30, and the closed upper end of the cleaner case main body 26. A wing nut 38 screws onto the bolt 37 engaging the retaining plate 30 from above. Tightening the wing nut 38 enables the first and second cleaner elements 28 and 29, the cover plate 27 of the cleaner case 25, and the intake pipe 23, which are held between the two retaining plates 30 and 31, to be made into a unit. A plurality of ribs 26*b* are provided at the closed upper end of the cleaner case main body 26 of the cleaner case 25 and abut the retaining plate 30 from above. Screwing and tightening a wing nut 39 around a portion of the bolt 37 projecting upward from the closed upper end of the cleaner case main body 26 completes assembly of the air cleaner 24, thus connecting the air cleaner 24 to the intake pipe 23.

An exhaust system 41 of the engine includes an exhaust pipe 42 and an exhaust muffler 43. The exhaust pipe 42 is connected to the cylinder head 14 of the engine main body 11 on the side opposite to the carburetor 22. The exhaust muffler 43 is connected to the exhaust pipe 42 while being supported by a bracket 44 attached to the cylinder head 14 of the engine main body 11. A cover 45 covers the exhaust system 41.

A fuel tank 48 is disposed above the crankcase 12 of the engine main body 11. The fuel tank 48 is supported by support arms 49 and 50. The support arm 49 is provided integrally with the case main body 16 of the crankcase 12, while the support arm 50 is provided integrally with the cylinder block 13.

Figure 3:
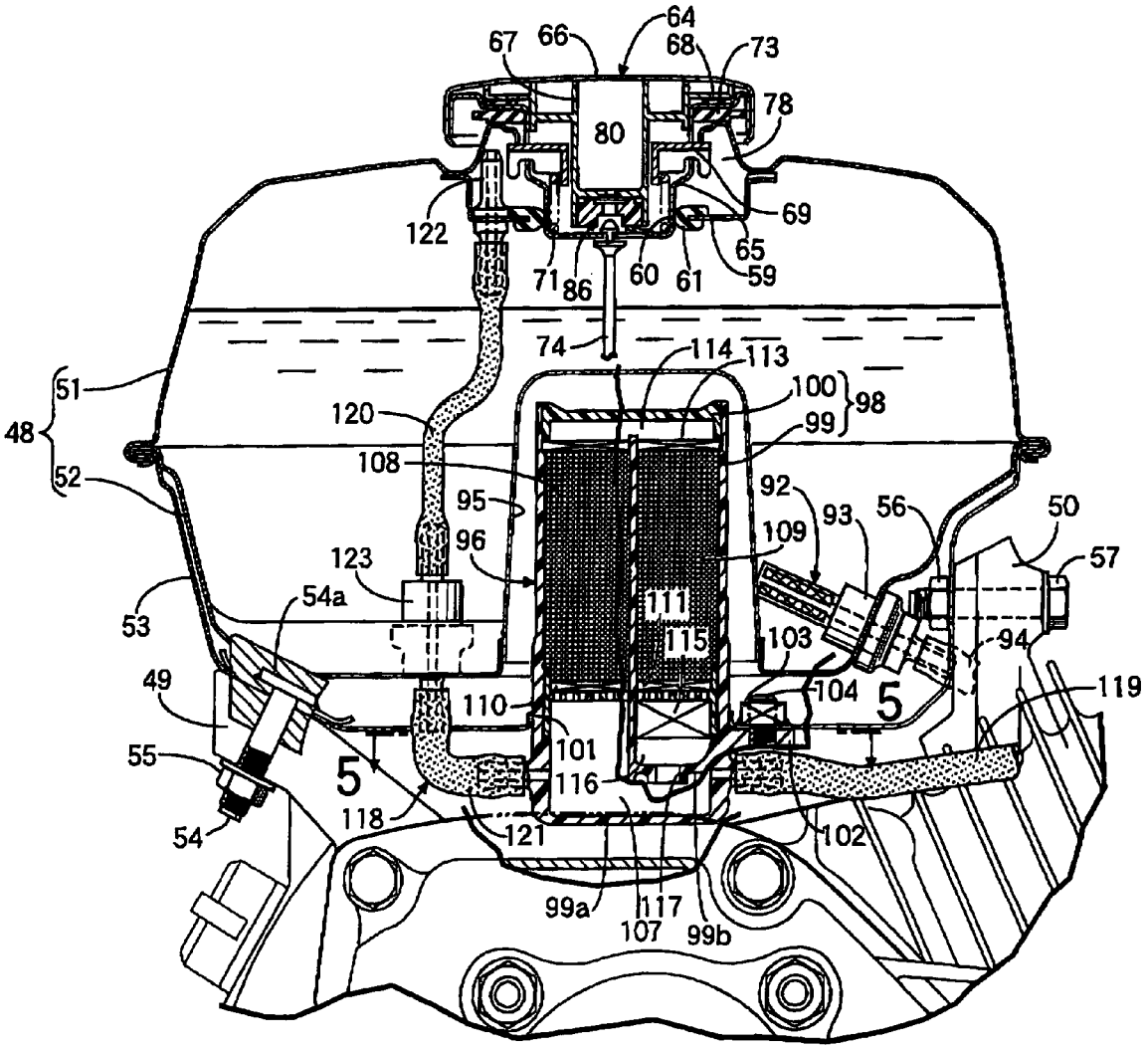
FIG. 3 is a sectional view of the fuel tank.

In FIG. 3, the fuel tank 48 is formed by joining the peripheral edge of an upper tank half 51 to the peripheral edge of a lower tank half 52. The upper tank half 51 forms a bowl shape that opens downward. The lower tank half 52 forms a bowl shape that opens upward. The peripheral edge of a support cover 53 is joined to the peripheral edges of the upper and lower tank halves 51 and 52. The support cover 53 forms a bowl shape that opens upward and covers the lower tank half 52 from below.

A head 54*a* of a bolt 54 is inserted through the support cover 53 and the support arm 49. Both a weld nut 56 and the head 54*a* of the bolt 54 are secured to an inner face of the support cover 53. A nut 55 is screwed around a portion of the bolt 54 projecting from the support arm 49. A bolt 57 inserted through the support arm 50 and the support cover 53 screws into the weld nut 56. Tightening the nut 55 and the bolt 57 enables the engine main body 11 to support the support cover 53 and the fuel tank 48.

Figure 4:
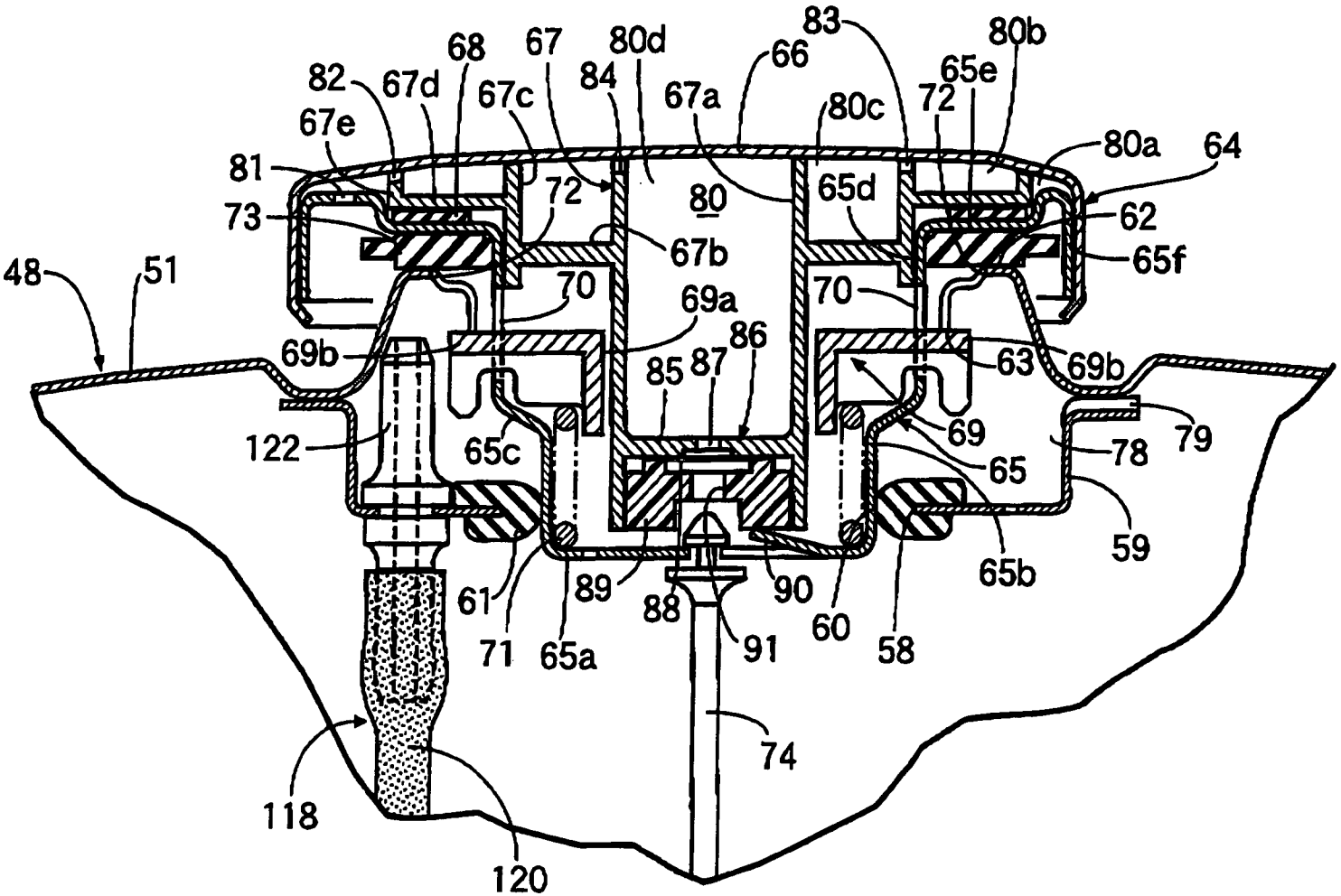
FIG. 4 is an enlarged view of an upper part of FIG. 3.

Referring to FIG. 4, a seal support member 59 is welded to a central portion of an inner face of the upper tank half 51 of the fuel tank 48. The central portion of the seal support member 59 has a seal-mounting hole 58 therein. Mounted in the seal-mounting hole 58 is an annular seal 61 forming a fuel filler hole 60 along an inner periphery thereof. Furthermore, a sealing portion 62 and a tubular latching portion 63 are integrally formed with the central portion of the upper tank half 51 at a position corresponding to the seal support member 59. The sealing portion 62 protrudes upward into a ring shape. The tubular latching portion 63 is connected to the inner periphery of the sealing portion 62 and extends downward.

The fuel filler hole 60 is closed with a tank cap 64 such that the fuel filler hole 60 can be opened and closed. The tank cap 64 includes an insertion tube 65, a dish-shaped operating member 66, and a support tube 67. The insertion tube 65 is removably inserted into the fuel filler hole 60. The operating member 66 is joined to the upper end of the insertion tube 65. The support tube 67 is held between the insertion tube 65 and the operating member 66.

The insertion tube 65 is integrally formed from a bottomed small-diameter cylindrical portion 65*b*, a tapered portion 65*c*, a large-diameter cylindrical portion 65*d*, a flange portion 65*e*, and a mating tubular portion 65*f*. The small-diameter cylindrical portion 65*b* has a lower end closed by an end wall 65*a*. The tapered portion 65*c* has a small-diameter end connected coaxially to an upper end of the small-diameter cylindrical portion 65*b*. The large-diameter cylindrical portion 65*d* is connected coaxially to a large-diameter end of the tapered portion 65*c*. The flange portion 65*e* extends radially outward from the other end of the large-diameter cylindrical portion 65*d*. The mating tubular portion 65*f* extends from the outer periphery of the flange portion 65*e* downward to surround the large-diameter cylindrical portion 65*d*. The small-diameter cylindrical portion 65*b* is inserted into the fuel filler hole 60 while in resilient sliding contact with the annular seal 61.

The mating tubular portion 65*f* of the insertion tube 65 is fitted into the operating member 66. The operating member 66 is joined to the upper end of the insertion tube 65 by swaging an open edge of the operating member 66 to engage the tip of the mating tubular portion 65*f*.

The support tube 67 integrally includes a first cylindrical portion 67*a*, a first connecting collar portion 67*b*, a second cylindrical portion 67*c*, a second connecting collar portion 67*d*, and a third cylindrical portion 67*e*. The first cylindrical portion 67*a* is disposed coaxially within the small-diameter cylindrical portion 65*b* of the insertion tube 65. The first connecting collar portion 67*b* projects radially outward from a middle portion proximate the upper end of the first cylindrical portion 67*a*. The second cylindrical portion 67*c* is fitted into the large-diameter cylindrical portion 65*d* of the insertion tube 65 to coaxially surround the first cylindrical portion 67*a*, and is connected to the outer periphery of the first connecting collar portion 67*b*. The second connecting collar portion 67*d* projects radially outward from a middle portion proximate the upper end of the second cylindrical portion 67*c*. The third cylindrical portion 67*e* is connected to the outer periphery of the second connecting collar portion 67*d* to coaxially surround the second cylindrical portion 67*c*. Upper ends of the first through third cylindrical portions 67*a*, 67*c*, and 67*e* abut the closed end of the operating member 66.

An annular spacer 68, which is made of an elastic material, is held between the second connecting collar portion 67*d* of the support tube 67 and the flange portion 65*e* of the insertion tube 65. By swaging the open edge of the operating member 66 to engage the mating tubular portion 65*f* of the insertion tube 65, the operating member 66 is joined to the upper end of the insertion tube 65, and the support tube 67 is held between the insertion tube 65 and the operating member 66.

An engagement member 69 is slidably supported on the first cylindrical portion 67*a* of the support tube 67 beneath the first connecting collar portion 67*b*. The engagement member 69 integrally includes a cylindrical boss 69*a* and a pair of engagement arms 69*b*. The cylindrical boss 69*a* is fitted around the first cylindrical portion 67*a*. The engagement arms 69*b* extend to opposite sides from the cylindrical boss 69*a* on one diameter of the first cylindrical portion 67*a*. Provided in the large-diameter cylindrical portion 65*d* of the insertion tube 65 are a pair of slits 70 extending in the axial direction through which the two engagement arms 69*b* extend. That is, the engagement member 69 is mounted on the tank cap 64 to prevent the engagement member 69 from pivoting around an axis of the engagement member 69 by the two slits 70, and the axial sliding range of the engagement member 69 is restricted by longitudinally opposite ends of the two slits 70. A spring 71 is provided under compression between the end wall 65*a* of the insertion tube 65 and the engagement member 69 so that the spring 71 exhibits a spring force urging the engagement member 69 toward the first connecting collar portion 67*b* of the support tube 67.

Tips of the engagement arms 69*b* of the engagement member 69 project from the large-diameter cylindrical portion 65*d* of the insertion tube 65. A pair of cutouts 72 is formed in the tubular latching portion 63 of the fuel tank 48. The tips of the engagement arms 69*b* are removably inserted into the cutouts 72. The tubular latching portion 63 is formed so that the tubular latching portion 63 pushes the engagement member 69 compressing the spring 71. Tank cap 64 then pivots in one direction through a predetermined angle while the tips of the engagement arms 69*b* are inserted into the cutouts 72. When the tank cap 64 pivots through the predetermined angle, the latching portion 63 engages the engagement arms 69*b* of the engagement member 69 resiliently urged by the spring 71, thereby maintaining the mounting state of the tank cap 64.

A ring-shaped gasket 73 is fitted around the outer periphery of the large-diameter cylindrical portion 65*d* of the insertion tube 65 in the tank cap 64. When the tank cap 64 is fitted into the fuel tank 48, the gasket 73 is held between the sealing portion 62 of the fuel tank 48 and the flange portion 65*e* of the insertion tube 65 in the tank cap 64.

An upper end portion of a strap 74 is secured to the end wall 65*a* of the insertion tube 65 in the tank cap 64. The lower end of the strap 74 is formed integrally with a hook (not illustrated) that does not easily pass through the filler hole 60. Therefore, even when the tank cap 64 is detached from the fuel tank 48, the hook catches on the seal support member 59 at the peripheral edge of the fuel filler hole 60 and prevents the tank cap 64 from falling off.

When the tank cap 64 is mounted on the fuel tank 48, the sealing portion 62 of the fuel tank 48, the seal support member 59, and the tank cap 64 form an annular fuel vapor passage 78 surrounding the tank cap 64. A channel 79 is provided on the seal support member 59 to provide communication between the fuel vapor passage 78 and the interior of the fuel tank 48. The seal support member 59 and an inner face of the upper tank half 51 of the fuel tank 48 form the channel 79. That is, the fuel vapor passage 78 communicates with the interior of the fuel tank 48.

An external communication passage 80, formed between the operating member 66 and the support tube 67 of the tank cap 64, communicates with the exterior of fuel tank 48. The external communication passage 80 includes a first annular passage portion 80*a*, a second annular passage portion 80*b*, a third annular passage portion 80*c*, and a central passage portion 80*d*. The first annular passage portion 80*a* is formed between the flange portion 65*e* of the insertion tube 65 and the operating member 66 outside the third cylindrical portion 67*e* of the support tube 67. The second annular passage portion 80*b* is formed between the second and third cylindrical portions 67*c* and 67*e* of the support tube 67. The third annular passage portion 80*c* is formed between the first and second cylindrical portions 67*a* and 67*c* of the support tube 67. The central passage portion 80*d* is formed within the first cylindrical portion 67*a* of the support tube 67.

An external communication hole 81, provided on the flange portion 65*e* of the insertion tube 65, provides communication between the first annular passage portion 80*a* and the exterior of fuel tank 48. A communication channel 82, provided at the upper end of the third cylindrical portion 67*e* of the support tube 67, provides communication between the first and second annular passage portions 80*a* and 80*b*. A communication channel 83, provided at the upper end of the second cylindrical portion 67*c* of the support tube 67, provides communication between the second and third annular passage portions 80*b* and 80*c*. A communication channel 84, provided at the upper end of the first cylindrical portion 67*a* of the support tube 67, provides communication between the third annular passage portion 80*c* and the central passage portion 80*d*.

A partition 85 is integrally provided in the inner periphery of the first cylindrical portion 67*a* proximate a lower end thereof. Partition 85 defines the lower end of central passage portion 80*d* of the external communication passage 80 and divides the interior of the first cylindrical portion 67*a* into upper and lower parts.

A one-way valve 86 is provided within the tank cap 64 and opens allowing communication between the external communication passage 80 and the interior of the fuel tank 48 when the pressure in the fuel tank 48 is lower than the external pressure. The one-way valve 86 includes a valve hole 87 and a leaf valve member 88. The valve hole 87 is provided in a central part of the partition 85 and extends coaxially to the lower end of the central passage portion 80*d* of the external communication passage 80. The leaf valve member 88 is capable of closing the valve hole 87 by sitting on the central part of the partition 85 from the side opposite to the central passage portion 80*d*.

A blocking member 89 fits into a lower end part of the first cylindrical portion 67*a*. Blocking member 89 is retained within the first cylindrical portion 67*a* by a support piece 90 that abuts the blocking member 89. The support piece 90 is formed by cutting and raising a part of the end wall 65*a* of the insertion tube 65.

A passage 91 is provided in a central part of the blocking member 89 and communicates with the interior of the fuel tank 48. The passage 91 permits the internal pressure of fuel tank 48 to be exerted on a side of leaf valve member 88 opposite the partition 85. The gap between the blocking member 89 and the partition 85 is such that leaf valve member 88 may open and close.

Referring again to FIG. 3, a housing recess 95, formed in the base of the fuel tank 48, is recessed toward the interior of the fuel tank 48. The housing recess 95, cylindrical in shape with a closed upper end and an open lower end, is located at a position below and offset from the tank cap 64 and is welded to the lower tank half 52. A canister 96 is housed within the housing recess 95.

Referring also to FIG. 3, a casing 98 of the canister 96 is made of a synthetic resin and includes a casing main body 99 and a cover 100. The casing main body 99 has a cylindrical shape with a closed lower end and extends vertically. The cover 100 is fitted into and fixed to the casing main body 99 to close an upper end opening of the casing main body 99. The casing 98 is inserted into the housing recess 95 from an opening 101 provided in the support cover 53 that covers the fuel tank 48 from below. A plurality of, for example, three, mounting arms 102 provided integrally with a lower part of the casing main body 99 are attached to the support cover 53 by weld nuts 103 and bolts 104. The weld nuts 103 are secured to an inner face of the support cover 53. The bolts 104 are inserted into the mounting arms 102 and support cover 53, and are screwed into the weld nuts 103.

Figure 6:
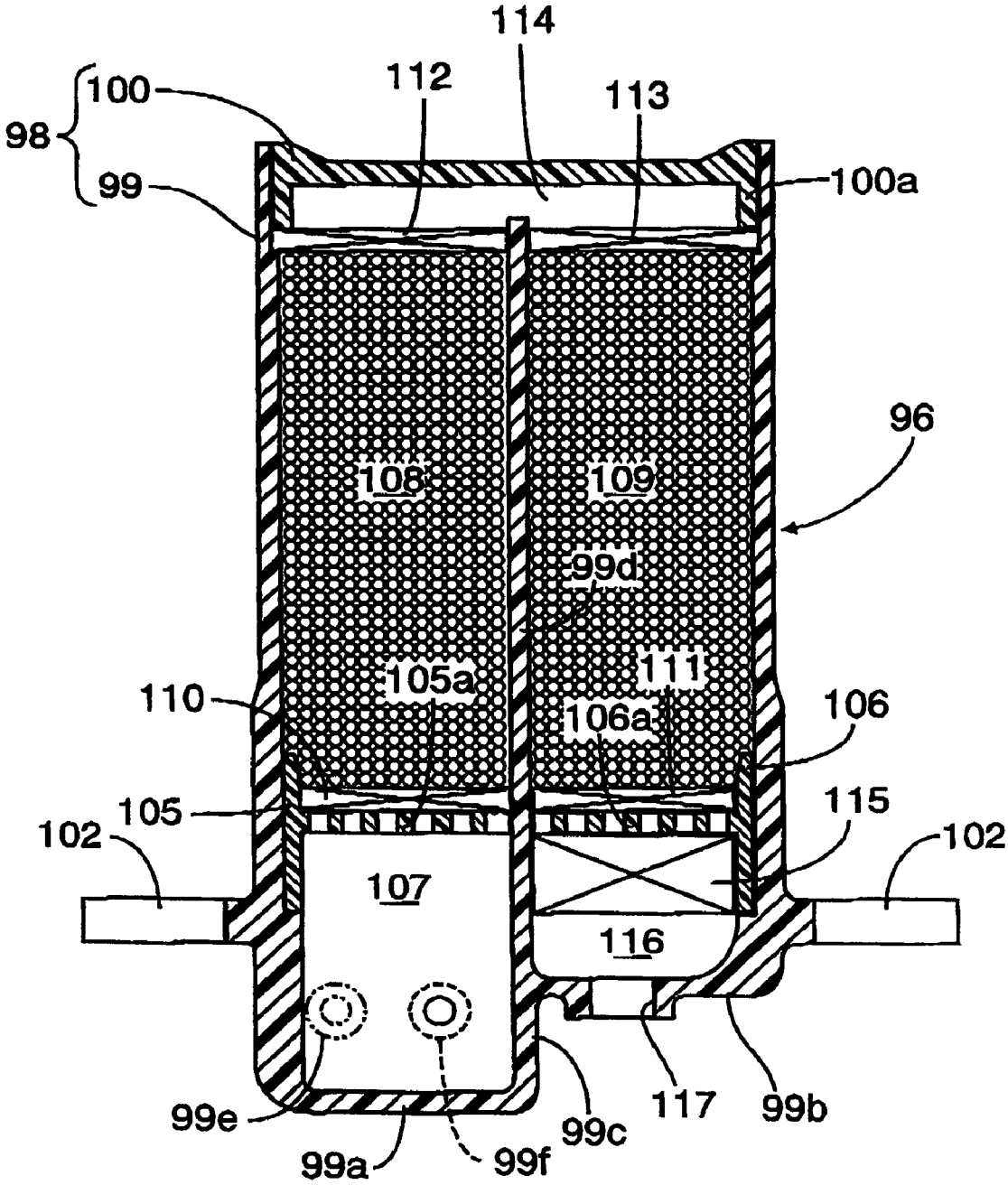
FIG. 6 is a sectional view along line 6—6 in FIG. 5.

Referring also to FIG. 6, the closed lower end of the casing main body 99 is formed from a semicircular first end wall portion 99*a*, a semicircular second end wall portion 99*b*, and a connecting wall portion 99*c*. The first end wall portion 99*a* closes the lower end of substantially half of the casing main body 99. The second end wall portion 99*b* is disposed above the first end wall portion 99*a* to close the lower end of the remainder of the casing main body 99. The connecting wall portion 99*c* is disposed on one diameter of the casing main body 99, and provides a connection between the first and second end wall portions 99*a* and 99*b*. Provided integrally with an inner face of the casing main body 99 is a partition wall portion 99*d*, which is connected to the connecting wall portion 99*c* and extends upward. The partition wall portion 99*d* divides the interior of the casing main body 99 into left and right portions corresponding to the first and second end wall portions 99*a* and 99*b*.

First and second support members 105 and 106 are fitted into and fixed to a lower part of the interior of the casing main body 99. Provided integrally with the first and second support members 105 and 106 are grid portions 105*a* and 106*a* that have semicircular exterior shapes corresponding to the first and second end wall portions 99*a* and 99*b*, respectively, and which are formed into grid shapes to allow the circulation of fuel vapor. An introduction chamber 107 is formed within the casing main body 99 between the grid portion 105*a* of the first support member 105 and the first end wall portion 99*a*.

A first adsorbent layer 108, packed with an adsorbent such as activated carbon, is housed within the casing main body 99 on one side of the partition wall portion 99*d*, wherein a filter 110 is disposed between the first adsorbent layer 108 and the grid portion 105*a* of the first support member 105. A second adsorbent layer 109, packed with an adsorbent such as activated carbon, is housed within the casing main body 99 on the other side of the partition wall portion 99*d*, wherein a filter 111 is disposed between the second adsorbent layer 109 and the grid portion 106*a* of the second support member 106.

The first and second adsorbent layers 108 and 109 are held between filters 110, 112 and filters 111,113, respectively. Provided integrally with the cover 100 closing the open end of the casing main body 99 is a tubular retaining portion 100*a* fitted into the interior of the casing main body 99 so that the filters 112 and 113 are held between the tubular retaining portion 100*a* and the first and second adsorbent layers 108, 109, respectively. Moreover, a middle chamber 114 is formed between the filters 112, 113 and the cover 100.

A filter 115, abutting the grid portion 106*a* from below, is fitted within the casing main body 99 beneath the grid portion 106*a* of the second support member 106. A discharge chamber 116 is formed within the casing main body 99 between the filter 115 and the second end wall portion 99*b*.

An open-to-atmosphere hole 117, providing communication between the discharge chamber 116 and the exterior of casing 98, is provided in the second end wall portion 99*b*, wherein the hole 117 opens toward the crankcase 12 of the engine main body 11.

Figure 5:
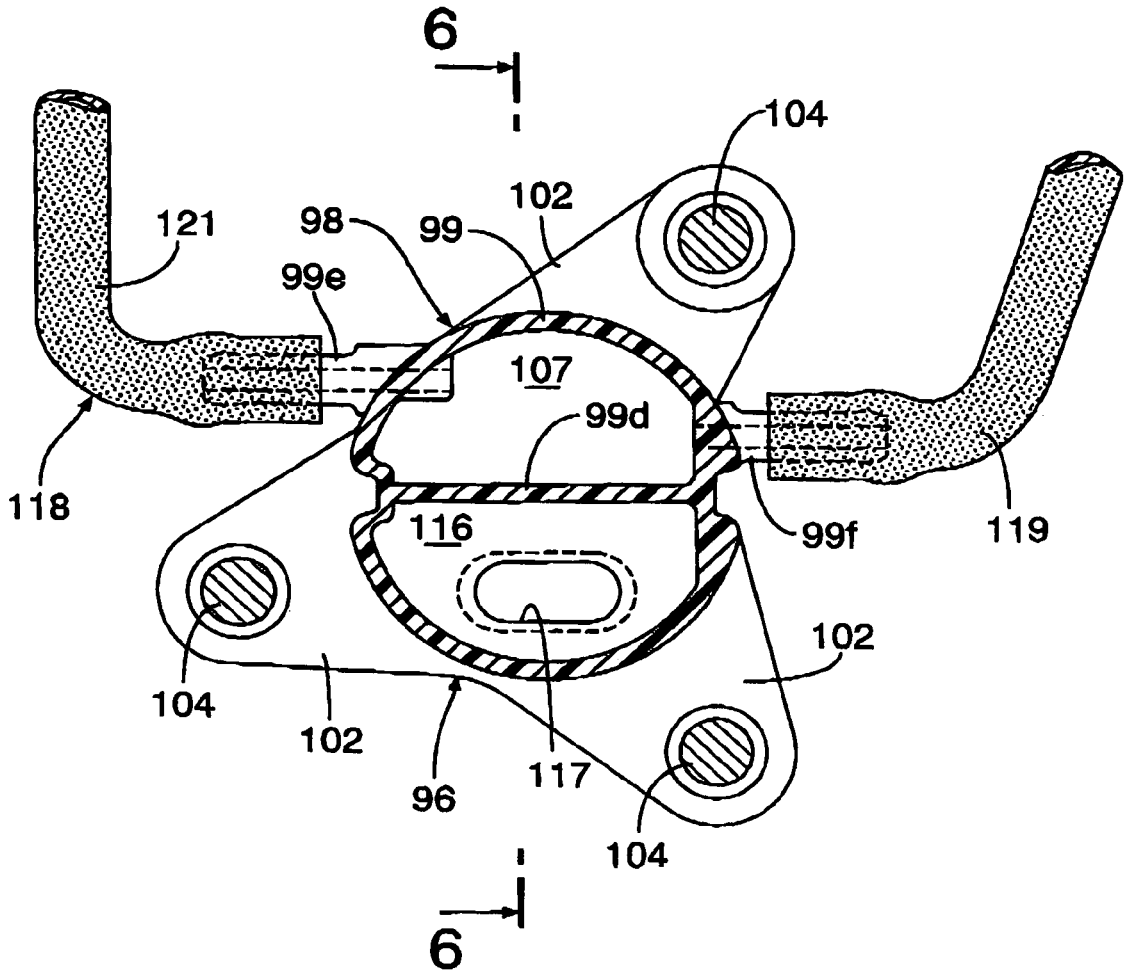
FIG. 5 is an enlarged sectional view along line 5—5 in FIG. 3.

Referring to FIG. 5, a pair of connecting tube portions 99*e* and 99*f* that communicate with the introduction chamber 107 are projectingly provided integrally with a lower part of the casing main body 99, wherein the connecting tube portions 99*e* and 99*f* project outward at positions offset from each other along the periphery of the casing main body 99. Connected to the connecting tube portion 99*e* is a charge pipeline 118 for guiding fuel vapor from the fuel tank 48. Connected to the connecting tube portion 99*f* is a purge pipeline 119 for guiding fuel vapor that has desorbed from the canister 96 to the intake pipe 23.

Referring again to FIG. 3, the charge pipeline 118 includes pipelines 120 and 121. The pipeline 120 is formed between the tank cap 64 and the fuel tank 48, providing communication with the interior of the fuel tank 48 via fuel vapor passage 78. The pipeline 121 provides a connection between the pipeline 120 and the canister 96. The pipelines 120 and 121 are, for example, rubber hoses.

A connecting tube 122 extends vertically through the seal support member 59 of the fuel tank 48 on the side opposite to the canister 96 relative to the axis of the tank cap 64. A middle portion of the connecting tube 122 is mounted on the seal support member 59, wherein the upper end of the connecting tube 122 communicates with the fuel vapor passage 78. The lower end of the connecting tube 122 is connected to the upper end of the pipeline 120. A connecting tube 123 extends vertically through the base of the lower tank half 52 of the fuel tank 48 in a liquid-tight manner. A middle portion of the connecting tube 123 is mounted on the base of the lower tank half 52. The upper end of the connecting tube 123 is connected to the lower end of the pipeline 120. The pipeline 121 extends through the support cover 53 and is connected to the lower end of the connecting tube 123.

That is, the pipeline 120 of the charge pipeline 118 is provided entirely within fuel tank 48 and communicates with the fuel vapor passage 78. Therefore, it is possible to reduce the portion of the charge pipeline 118 exposed to the exterior of fuel tank 48; reduce the overall dimensions of the general-purpose engine and consequently the dimensions of the work machine; enhance the ease of mounting and the appearance of the general-purpose engine, thereby improving product quality; and improve safety while taking into consideration the leakage of fuel vapor, damage to the pipelines, etc.

Referring again to FIG. 2, one end of the purge pipeline 119 communicates with the introduction chamber 107, and the other end connects to a connecting tube portion 35*b* that is integral with the pipe 35 of the intake pipe 23 in the intake system 21.

Referring again to FIG. 3, a filter case 93 equipped with a filter 92 for filtering fuel within the fuel tank 48 mounts on the base of the lower tank half 52 of the fuel tank 48. A fuel hose 94 for guiding fuel to the carburetor 22 is connected to the filter case 93.

In the canister 96, fuel vapor that has evaporated in the fuel tank 48 when the engine is stopped feeds from the charge pipeline 118 to the introduction chamber 107. Once in the introduction chamber 107, the fuel vapor flows toward the discharge chamber 116 via the grid portion 105*a* of the first support member 105, the filter 110, the first adsorbent layer 108, the filter 112, the middle chamber 114, the filter 113, the second adsorbent layer 109, the filter 111, the grid portion 106*a* of the second support member 106, and the filter 115. The first and second adsorbent layers 108 and 109 adsorb the fuel vapor.

When the engine is running, air introduced into the discharge chamber 116 through the open-to-atmosphere hole 117 flows toward the intake pipe 23 via the filter 115, the grid portion 106*a* of the second support member 106, the filter 111, the second adsorbent layer 109, the filter 113, the middle chamber 114, the filter 112, the first adsorbent layer 108, the filter 110, the grid portion 105*a* of the first support member 105, the introduction chamber 107, and the purge pipeline 119. The fuel vapor that has desorbed from the first and second adsorbent layers 108 and 109 is guided to the intake pipe 23 side accompanied by the air.

In this way, the interior of the casing 98 of the canister 96 is divided into left and right portions by the partition wall portion 99*d*, and the fuel vapor or the air for accompanying the fuel vapor flows sequentially through the first adsorbent layer 108 on one side of the partition wall portion 99*d* and the second adsorbent layer 109 on the other side of the partition wall portion 99*d*. Therefore, it is possible to increase the adsorption length while keeping the casing 98 compact, thus improving adsorption efficiency.

Operation of the invention according to the embodiment described above will now be explained. The housing recess 95, recessed toward the interior of the fuel tank 48, is formed in the base of the fuel tank 48, and the canister 96 is housed in the housing recess 95. Therefore, the canister 96 may be arranged within the general-purpose engine while avoiding any increase in the overall dimensions of the general-purpose engine. Moreover, placement of canister 96 within housing recess 95 greatly reduces the possibility of an external impact to the canister 96.

Further, the fuel tank 48 is disposed above the crankcase 12 of the engine main body 11. Hence, the hole 117 within the casing 98 of the canister 96, providing communication between the interior and exterior of canister 96, opens downward toward the crankcase 12. Therefore, the engine main body 11 covers the area around hole 117 and improves the durability of the canister 96 by reducing the amount of dirt and moisture drawn into the canister 96 through hole 117.

Further, the external communication passage 80 of the tank cap 64 provides communication between the interior and exterior of tank cap 64. The one-way valve 86 also opens allowing communication between the external communication passage 80 and the interior of fuel tank 48 when the pressure within the fuel tank 48 is lower than the external pressure. Therefore, even when air flow resistance through the charge pipeline 118, canister 96, and intake system 21 increases due to the adsorption of fuel vapor or residing impurities in the canister 96, operation of the one-way valve 86 prevents the pressure within the fuel tank 48 from becoming negative, which provides a smooth supply of fuel from the fuel tank 48, even when the fuel level within the fuel tank 48 decreases.

Although a preferred embodiment of the present invention has been described in detail, the present invention is not limited to the embodiment and can be modified in a variety of ways without departing from the spirit and scope of the present invention.

What is claimed is:

1. A general-purpose engine comprising:

an engine main body;

a fuel tank;

a canister which adsorbs fuel vapor evaporated within the fuel tank;

an intake system communicating with the engine main body, wherein fuel vapor desorbed from the canister is guided to the intake system;

a housing recess formed in a base of the fuel tank, the housing recess being recessed toward an interior of the fuel tank and housing the canister; and a charge pipeline extending through the interior of the fuel tank for conveying fuel vapor from the fuel tank to the canister.

2. The engine according to claim 1, wherein the fuel tank is disposed above an engine component forming a part of the engine main body, the canister having an open-to-atmosphere hole provided in a casing of the canister which opens toward the engine component and provides communication between an interior and exterior of the casing.

3. The engine according to claim 1, the engine further comprising:

a tank cap securably affixed to the fuel tank comprising:

a one-way valve;

an external communication passage; and a fuel vapor passage, wherein the one-way valve opens when an external pressure of the fuel tank exceeds an internal pressure of the fuel tank, wherein the external communication passage provides communication between an exterior and the interior of the fuel tank when the one-way valve opens, wherein the fuel vapor passage provides communication between the interior of the fuel tank and the charge pipeline, and wherein the charge pipeline provides communication between the fuel vapor passage and the canister.

4. The engine according to claim 3, wherein the charge pipeline comprises a plurality of pipes.

5. The engine according to claim 4, wherein the plurality of pipes are formed from an elastomeric material.

6. The engine according to claim 5, wherein the canister is internally partitioned and increases a flow distance of any fuel vapor traveling through the canister from a canister inlet to an open-to-atmosphere hole communicating with the canister exterior.

7. The engine according to claim 2, the engine further comprising:

a tank cap securably affixed to the fuel tank comprising a one-way valve and an external communication passage, wherein the one-way valve opens when an external pressure of the fuel tank exceeds an internal pressure of the fuel tank, wherein the external communication passage provides communication between an exterior and the interior of the fuel tank when the one-way valve opens, wherein the tank cap integrally includes a fuel vapor passage providing communication between the interior of the fuel tank and the charge pipeline, and wherein the charge pipeline provides communication between the fuel vapor passage and the canister.

8. The engine according to claim 7, wherein the charge pipeline comprises a plurality of pipes.

9. The engine according to claim 8, wherein the plurality of pipes are formed from an elastomeric material.

10. The engine according to claim 9, wherein the canister is internally partitioned and increases a flow distance of any fuel vapor traveling through the canister from a canister inlet to an open-to-atmosphere hole communicating with the canister exterior.

* * * * *